US009790722B2

(12) United States Patent
Sun et al.

(10) Patent No.: US 9,790,722 B2
(45) Date of Patent: Oct. 17, 2017

(54) REFRIGERATOR AND LOWER HINGE MODULE

(71) Applicant: SAMSUNG ELECTRONICS CO., LTD., Suwon-si (KR)

(72) Inventors: Mu Yeol Sun, Gwangju (KR); Dong In Shin, Gwangju (KR); Hong Joo Mun, Suwon-si (KR); Sung Wook Kang, Seoul (KR); Teleginyury, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/079,067

(22) Filed: Nov. 13, 2013

(65) Prior Publication Data

US 2014/0132141 A1 May 15, 2014

(30) Foreign Application Priority Data

Nov. 13, 2012 (KR) ..... 10-2012-0128190

(51) Int. Cl.
*F25D 23/02* (2006.01)
*E05D 7/00* (2006.01)

(52) U.S. Cl.
CPC ..... *E05D 7/0027* (2013.01); *F25D 23/028* (2013.01); *F25D 2323/021* (2013.01); *Y10T 16/5327* (2015.01)

(58) Field of Classification Search
CPC ..... F25D 23/028; F25D 2323/021; E05D 7/0027; Y10T 16/53235; Y10T 16/53253; Y10T 16/53257; Y10T 16/5327
USPC ..... 312/404–405, 400–401, 326, 329; 16/248, 240, 245–246
See application file for complete search history.

(56) References Cited

U.S. PATENT DOCUMENTS 975,285 A * 11/1910 Robertson ..... 411/403
2,190,741 A * 2/1940 Sylvester ..... 49/337
2,828,578 A * 4/1958 McCabe ..... 248/188.4
4,070,728 A * 1/1978 Herman ..... E05D 7/0415 16/243

(Continued)

FOREIGN PATENT DOCUMENTS

CN 1837723 9/2006
CN 201892366 7/2011

(Continued)

OTHER PUBLICATIONS

Chinese Office Action dated Dec. 13, 2016 from Chinese Patent Application No. 201310565506.2, 20 pages.

(Continued)

*Primary Examiner* — James O Hansen
(74) *Attorney, Agent, or Firm* — Staas & Halsey LLP

(57) ABSTRACT

A refrigerator, with respect to the refrigerator having a plurality of doors to open/close a storage compartment, capable of adjusting the height of the plurality of doors as to adjust the height difference that occurs between the plurality of doors. A lower hinge module of the refrigerator includes a hinge shaft being inserted into a lower portion of the door, a worm wheel coupled to the hinge shaft so as to be ascended/descended while supporting the weight of the door, and a worm engaged with the worm wheel to rotate the worm wheel.

19 Claims, 5 Drawing Sheets

(56) References Cited

U.S. PATENT DOCUMENTS

| | | | | |
|---|---|---|---|---|
| 4,646,472 | A * | 3/1987 | Sugawara | E05F 1/123 16/238 |
| 4,696,078 | A * | 9/1987 | Stromquist | E05F 1/123 16/301 |
| 4,864,691 | A * | 9/1989 | Gidseg | E05D 3/04 16/312 |
| 4,905,347 | A * | 3/1990 | Wroth | E05F 1/123 16/308 |
| 5,495,639 | A * | 3/1996 | Wartian | E05F 1/1016 16/79 |
| 5,694,665 | A * | 12/1997 | Strickland et al. | 16/238 |
| 5,701,636 | A * | 12/1997 | Jahnke | 16/238 |
| 6,948,408 | B1 * | 9/2005 | Lee | 81/436 |
| 8,650,712 | B2 * | 2/2014 | Wach | E05D 7/0415 16/236 |
| 8,662,608 | B2 * | 3/2014 | Cui | E05D 7/0027 16/244 |
| 2005/0247834 | A1 * | 11/2005 | Thuelig | 248/188.4 |
| 2006/0179610 | A1 * | 8/2006 | Erickson et al. | 16/243 |
| 2010/0218342 | A1 * | 9/2010 | Bertolini | E05D 7/0027 16/244 |
| 2012/0038259 | A1 * | 2/2012 | Lee et al. | 312/405 |
| 2012/0181912 | A1 * | 7/2012 | Cui et al. | 312/405 |
| 2013/0076222 | A1 * | 3/2013 | Lee et al. | 312/405 |
| 2013/0154464 | A1 * | 6/2013 | Fiori | E05D 7/0423 312/405 |

FOREIGN PATENT DOCUMENTS

| | | | | |
|---|---|---|---|---|
| CN | 102365515 | | 2/2012 | |
| CN | 102374721 | | 3/2012 | |
| EP | 2447453 | A1 * | 5/2012 | E05D 5/02 |
| JP | 58-191878 | | 11/1983 | |
| KR | 20-1999-0015446 | | 5/1999 | |
| KR | 20-2000-0003877 | | 2/2000 | |
| KR | 10-2004-0046106 | | 6/2004 | |
| WO | WO 2006054942 | A1 * | 5/2006 | A47K 3/36 |
| WO | 2009/131295 | | 10/2009 | |

OTHER PUBLICATIONS

Extended European Search Report dated May 15, 2017 in corresponding European Patent Application No. 13190819.6.

Chinese Decision on Grant dated Jul. 24, 2017 in corresponding Chinese Patent Application No. 201310565506.2.

* cited by examiner

REFRIGERATOR AND LOWER HINGE MODULE

CROSS-REFERENCE TO RELATED APPLICATIONS

This application claims the priority benefit of the Korean Patent Application No. 10-2012-0128190, filed on Nov. 13, 2012, in the Korean Intellectual Property Office, the disclosure of which is incorporated herein by reference.

BACKGROUND

1. Field

The following description relates to a refrigerator having a plurality of rotating doors to open/close a storage compartment.

2. Description of the Related Art

In general, a refrigerator is a household appliance configured to store food for a long period of time in a fresh state while including a storage compartment to store food therein, and a cool air supplying apparatus to supply cool air to the storage compartment. The storage compartment is provided with an open front portion to put in or taken out food, and the open front portion may be open/closed by a door.

A certain refrigerator is provided with a plurality of doors that are rotatably disposed at a left side and a right side of a body, respectively, and at this time, the doors are coupled to the body by a hinge module. However, by a manufacturing error or by an assembly error, a height difference between the plurality of doors may occur, or by the weight of the doors or by the weight of the food stored at the door, a height difference between the plurality of doors may occur. The height difference as such may degrade the exterior appearance of the refrigerator, and furthermore, may cause an operational malfunction of the door.

Thus, in the refrigerator, a height adjustment structure configured to adjust the height difference of the plurality of doors may be adopted. However, the conventional height adjustment structure of the doors may generally be a structure having to remove the doors from the body, or a structure having difficulty for a user to directly adjust at home.

SUMMARY

Therefore, it is an aspect of the present disclosure to provide a refrigerator capable of adjusting the height difference of a plurality of doors by adjusting the height of the doors, and a lower hinge module of the same.

It is another aspect of the present disclosure to provide a refrigerator capable of easily adjusting the height of the doors by small force of a user at home, and a lower hinge module of the same.

Additional aspects of the disclosure will be set forth in part in the description which follows and, in part, will be apparent from the description, or may be learned by practice of the disclosure.

In accordance with an aspect of the present disclosure, a refrigerator includes a body, a storage compartment, a door, a hinge bracket, a hinge shaft, a worm wheel and a worm. The storage compartment may be provided at an inside the body. The door may be rotatably provided at the body to open/close the storage compartment. The hinge bracket may have a fixation part being fixed to a lower surface of the body, and an extension part extended from the fixation part to be disposed below the door. The hinge shaft may be protruded upward from the extension part to be inserted into a lower portion of the door, the hinge shaft provided at an outer circumferential surface thereof with a male screw part. The worm wheel may be provided at an inner circumferential surface thereof with a female screw part corresponding to the male screw part of the hinge shaft to be screw-coupled to the hinge shaft so as to ascend/descend while supporting a weight of the door. The worm may be engaged with the worm wheel to rotate the worm wheel.

When the worm is rotated, the worm wheel engaged with the worm may be rotated. When the worm wheel is rotated, a screw coupling degree of the worm wheel and the hinge shaft may be changed, and thus the worm wheel may be ascended or descended. When the worm wheel is ascended or descended, the door being supported by the worm wheel may be ascended or descended.

The refrigerator may further include a cam unit to allow the door to be semi-automatically open/closed, the cam unit including a lower cam unit fixed to the hinge bracket, and a upper cam unit fixed to the door to interoperate with the lower cam unit.

A rotation preventing protrusion may be provided at the hinge bracket. The lower cam unit may be provided with a rotation preventing grove into which the rotation preventing protrusion is inserted to prevent the lower cam unit from being rotated.

The refrigerator may further include a worm housing rotatably supporting the worm.

The worm housing may include a lower worm housing fixed to the hinge bracket and a upper worm housing coupled to the lower worm housing.

A worm operating part may be provided at the worm to rotate the worm.

A screw driver may be coupled to the worm operating part.

The hinge shaft may be integrally formed with the hinge bracket, or may be formed independently of the hinge bracket and fixedly coupled to the hinge bracket.

The refrigerator may further include a supporting leg provided in between the hinge bracket and a bottom surface, at which the body is disposed, to support the weight of the body.

In accordance with another aspect of the present disclosure, a refrigerator includes a body, a plurality of storage compartments, a plurality of door and a plurality of lower hinge modules. The plurality of storage compartments may be provided at an inside the body. The plurality of doors may be rotatably provided at the body to open/close the plurality of storage compartments. The plurality of lower hinge modules may be configured to respectively support the plurality of doors, and respectively adjust heights of the plurality of doors. The lower hinge module may include a hinge bracket, a hinge shaft, a worm wheel and a worm. The hinge bracket may connect the body to the door. The hinge shaft may be inserted into a lower portion of the door. The worm wheel may be screw-coupled to the hinge shaft so as to ascend/descend while supporting a weight of the door. The worm may be engaged with the worm wheel to rotate the worm wheel.

In accordance with another aspect of the present disclosure, a lower hinge module to support a door of a refrigerator, the lower hinge module includes a hinge bracket, a hinge shaft, a worm wheel and a worm. The hinge bracket may have a fixation part being fixed to a lower surface of a body of the refrigerator, and an extension part extended from the fixation part to be disposed below the door. The hinge shaft may be protruded upward from the extension part to be inserted into a lower portion of the door. The worm wheel may be screwed to the hinge shaft so as to ascend/descend while supporting a weight of the door. The worm may be engaged with the worm wheel to rotate the worm wheel.

A male screw part may be formed at an outer circumferential surface of the hinge shaft, and a female screw part corresponding to the male screw part may be formed at an inner circumferential surface of the worm wheel.

A worm operating part may be provided at the worm to rotate the worm.

A screw driver may be coupled to the worm operating part.

The hinge shaft may be integrally formed with the hinge bracket, or may be independently formed of the hinge bracket and is fixedly coupled to the hinge bracket.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
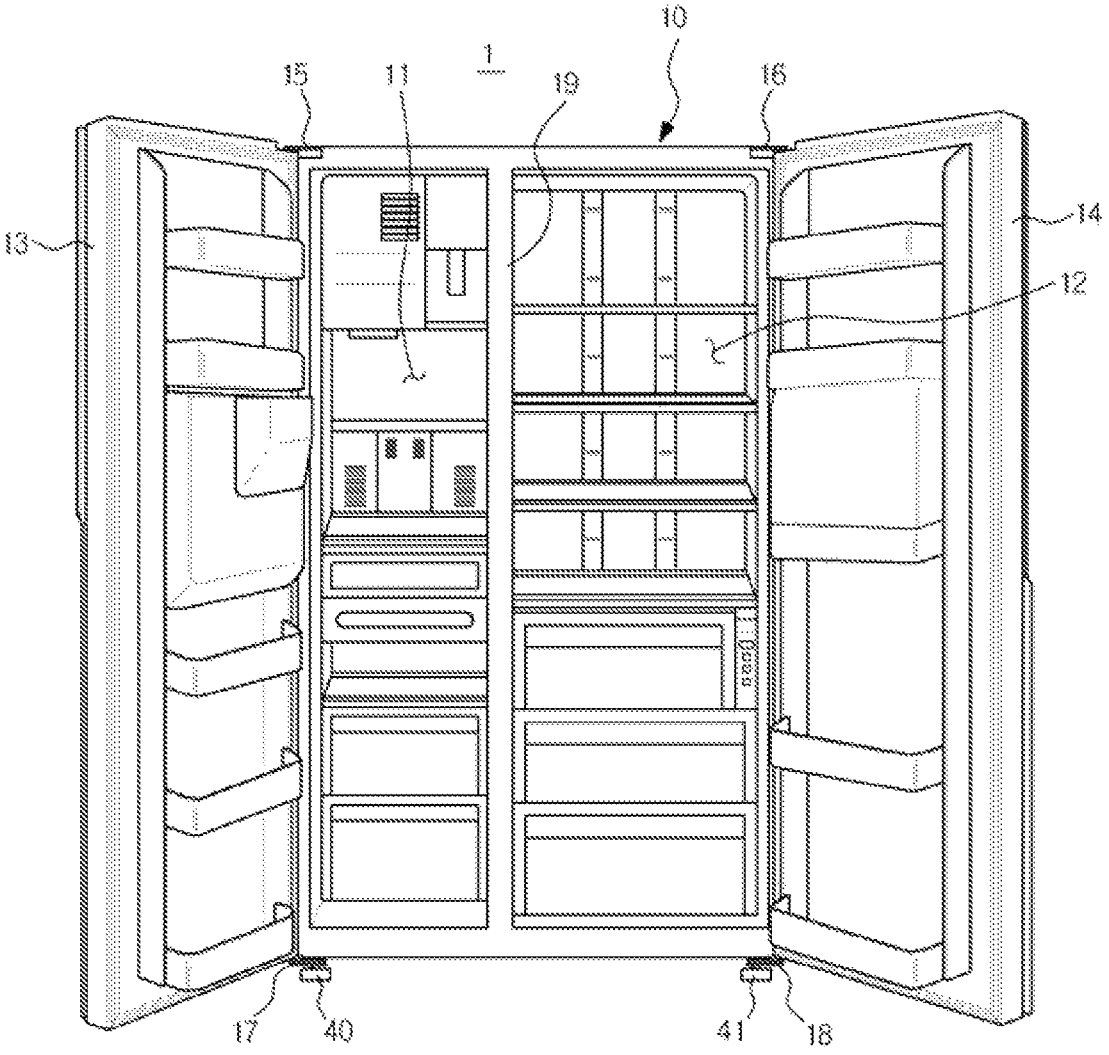
FIG. 1 is a front view of a refrigerator in accordance with an embodiment of the present disclosure.

Reference will now be made in detail to embodiments of the present disclosure, examples of which are illustrated in the accompanying drawings, wherein like reference numerals refer to like components throughout.

FIG. 1 is a front view of a refrigerator in accordance with an embodiment of the present disclosure.

Referring to FIG. 1, a refrigerator 1 is provided with a body 10 having storage compartments 11 and 12, a cool air supplying apparatus to supply cool air to the storage compartments 11 and 12, and doors 13 and 14 rotatably coupled to the body 10.

The storage compartments 11 and 12 are provided with open front portion for food to be put in or taken out, and the open front portion may be open/closed by the doors 13 and 14. The storage compartments 11 and 12 may be divided into a freezing compartment 11 on the left and a refrigerating compartment 12 on the right by a vertical mid wall 19. However, the positions of the freezing compartment and the refrigerating compartment may be changed according to design.

The cool air supplying apparatus includes a compressor (not shown), a condenser (not shown), an expansion valve (not shown), and an evaporator (not shown), and may be able to supply cool air to the storage compartments 11 and 12 by circulating refrigerant and by using evaporative latent heat of the refrigerant.

The freezing compartment 11 may be open/closed by the freezing compartment door 13 on the left side, and the refrigerating compartment 12 may be open/closed by the refrigerating compartment door 14 on the right side. The freezing compartment door 13 is rotatably coupled to the body 10 by an upper hinge module 15 and a lower hinge module 17, and the refrigerating compartment door 14 is rotatably coupled to the body 10 by an upper hinge module 16 and a lower hinge module 18. At a lower portion of the body 10, supporting legs 40 and 41 to support the weight of the body 10 may be provided.

The freezing compartment door 13 and the refrigerating compartment door 14 as such need to have the same height with respect to each other without having a height difference of the freezing compartment door 13 and the refrigerating compartment door 14. However, a manufacturing error or an assembly error, or the deflection phenomenon by the weight of the doors 13 and 14 may cause a height difference between the doors 13 and 14.

As the above, when a height difference between the doors 13 and 14 is occurred, the exterior appearance of the refrigerator may be degraded, and furthermore, an operational malfunction in the opening/closing of the doors 13 and 14 may be occurred. Thus, the refrigerator in accordance with an embodiment of the present disclosure is provided with a height adjusting structure for the doors 13 and 14 to adjust the height difference between the doors 13 and 14.

The height adjusting structure of the doors is provided at the lower hinge modules 17 and 18, and the height adjusting structure of the doors in accordance with an embodiment of the present disclosure enables easily access thereto, and delicately performs the adjustment of the height of the doors 13 and 14 by use of small force. The height adjusting structure of the doors will be described hereinafter.

Figure 2:
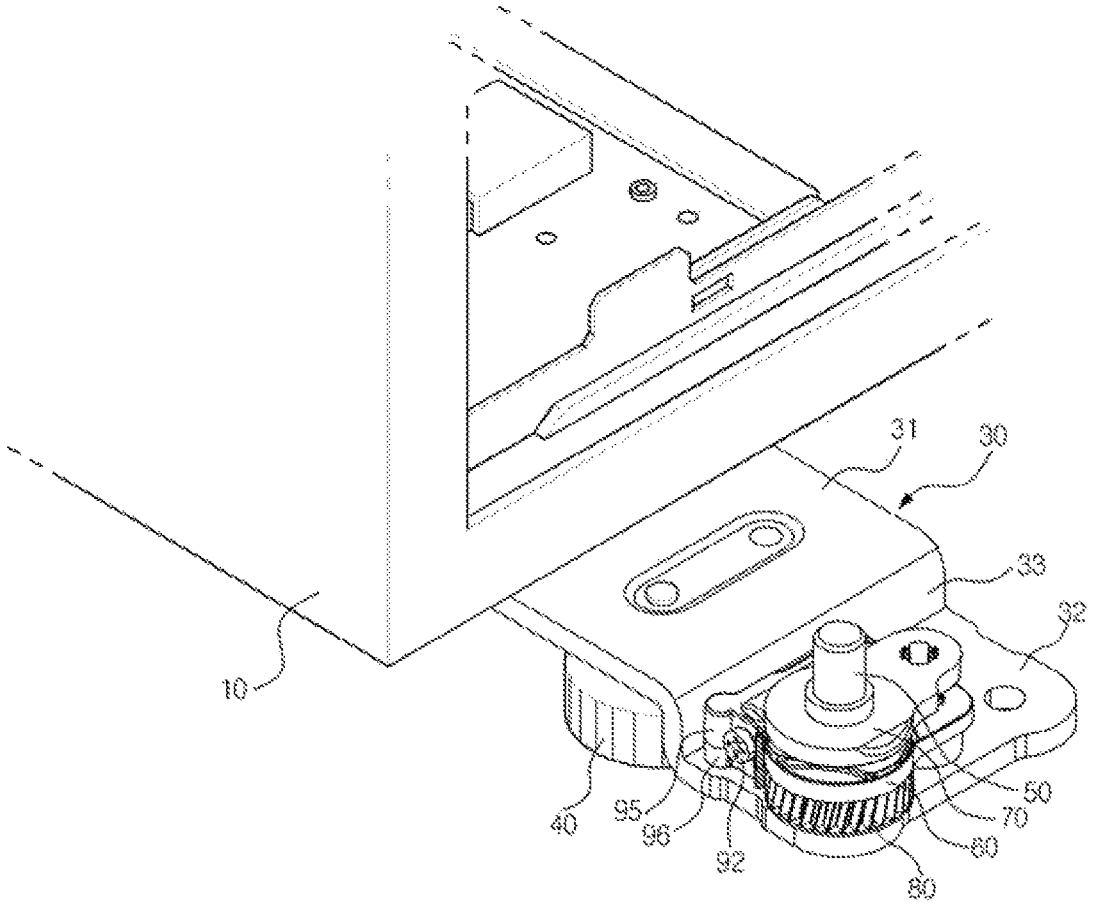
FIG. 2 is a perspective view illustrating a lower hinge module of the refrigerator of FIG. 1.
Figure 3:
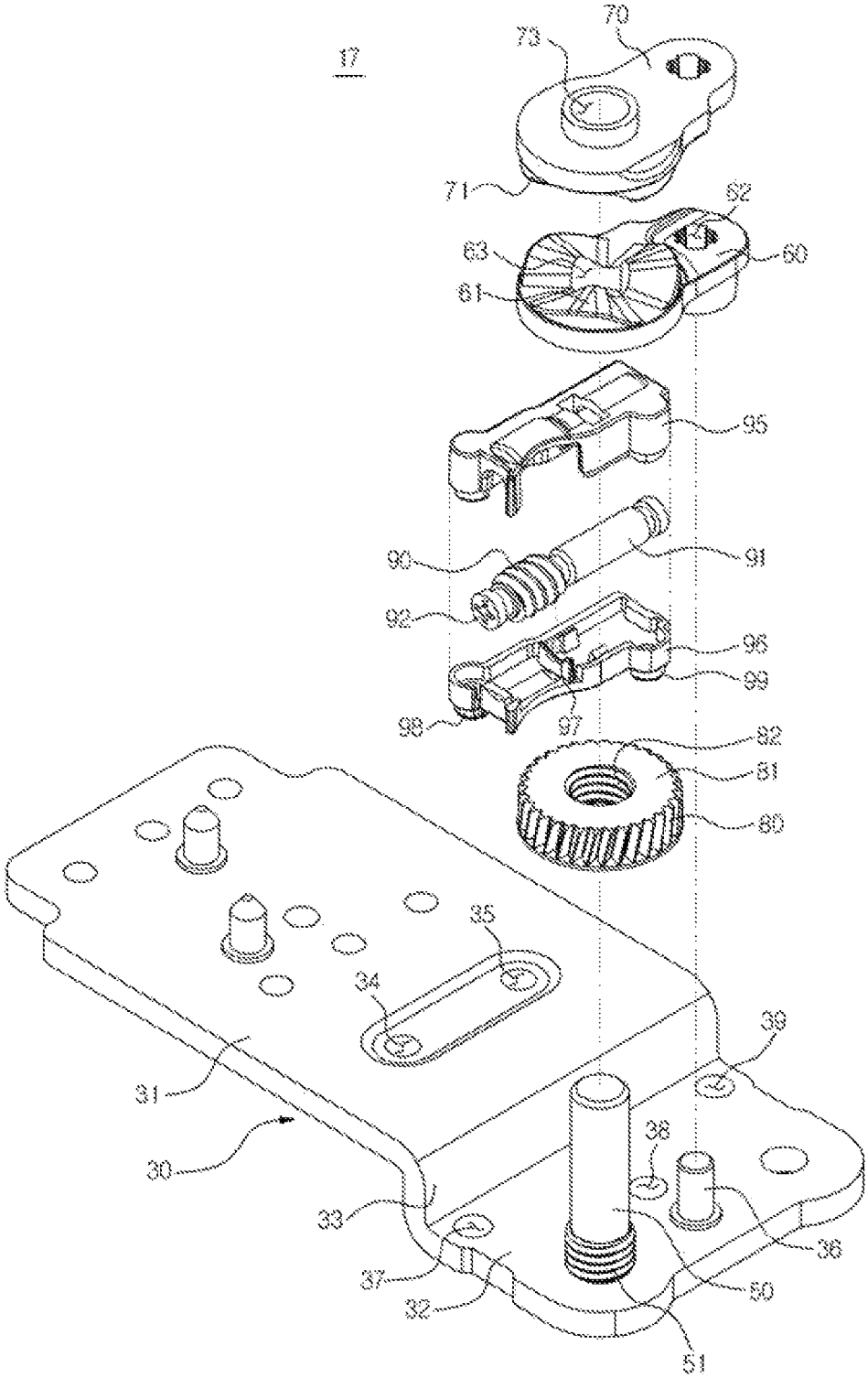
FIG. 3 is an exploded perspective view illustrating the lower hinge module of the refrigerator of FIG. 1.
Figure 4:
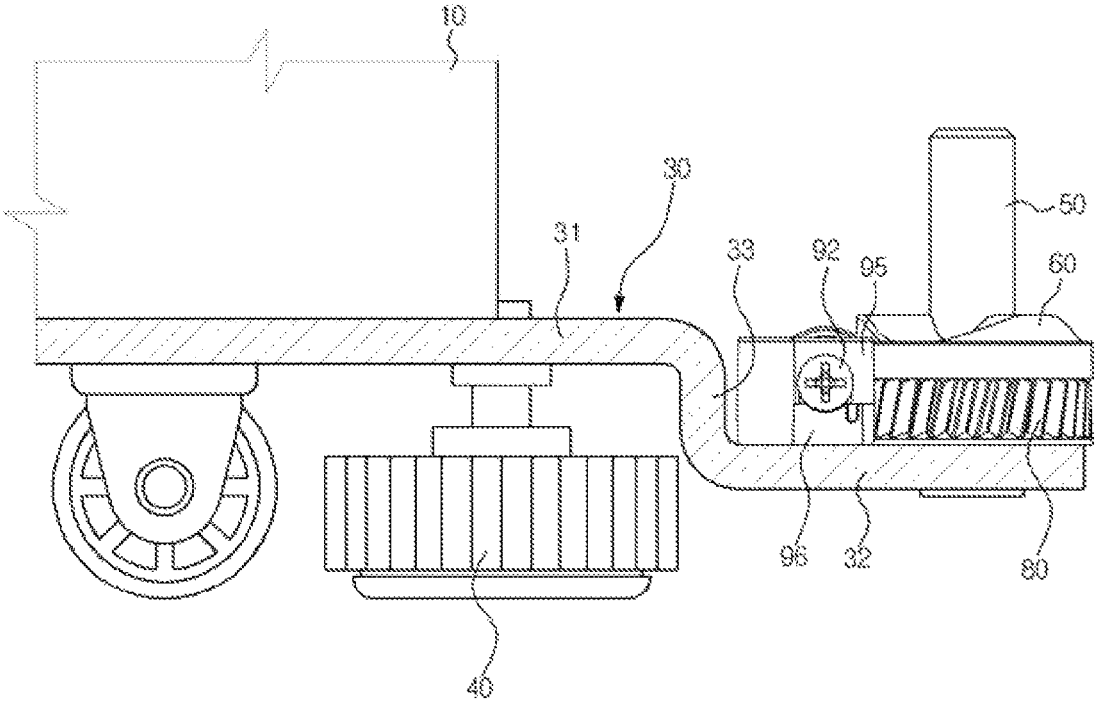
FIG. 4 is a side view illustrating the lower hinge module of the refrigerator of FIG. 1.

FIG. 2 is a perspective view illustrating the lower hinge module of the refrigerator of FIG. 1, FIG. 3 is an exploded perspective view illustrating the lower hinge module of the refrigerator of FIG. 1, and FIG. 4 is a side view illustrating the lower hinge module of the refrigerator of FIG. 1.

Referring to FIGS. 2 to 4, the structure of the lower hinge module of the refrigerator in accordance with an embodiment of the present disclosure is described. Here, the structures of the lower hinge module 17 on the left side and the lower hinge module 18 on the right side are same, and thus, the description will be provided only with respect to the structure of the lower hinge module 17 on the left side, and the description with respect to the structure of the lower hinge module 18 on the right side will be omitted.

The lower hinge module 17 includes a hinge bracket 30 connecting the body 10 to the door 13, a hinge shaft 50 being inserted into a lower portion of the door 13, a worm wheel 80 screwed to the hinge shaft 50 so as to ascend/descend while supporting the weight of the door 13, and a worm 90 engaged with the worm wheel 80 to rotate the worm wheel 80.

The hinge bracket 30 may be formed of the material having adequate strength to support the door 13. The hinge bracket 30 may include a fixation part 31 fixedly coupled to a lower portion of the door 13, an extension part 32 extended from the fixation part 31 and disposed below the door 13, and a stepped part 33 connecting the fixation part 31 to the extension part 32.

The hinge bracket 30 may be formed as an integral unit. The fixation part 31 and the extension part 32 each are provided in an approximately horizontal manner with respect to a bottom surface, and a step is formed between the fixation part 31 and the extension part 32 by the stepped part 33. That is, the extension part 32 may be positioned below the fixation part 31.

The fixation unit 31 of the hinge bracket 30 may be provided with one or more leg coupling holes 34 and 35, to which the supporting leg 40 configured to support the weight of the body 10 may be coupled.

The supporting leg 40 may be coupled to the leg coupling hole 34 located on the left side among the one or more leg coupling holes 34 and 35. The hinge bracket 30 in accordance with an embodiment of the present disclosure is provided with a versatility to be used with respect to the lower hinge module 17 on the left side and also with respect to the lower hinge module 18 on the right side, and when the hinge bracket 30 is being used with respect to the lower hinge module 18 on the right side, the supporting leg 40 may be coupled to the leg coupling hole 35 on the right side.

The supporting leg 40 may be disposed in between the hinge bracket 30 and a bottom surface to support the weight of the body 10.

The hinge shaft 50 is configured to substantially form a rotating shaft of the door 13, and is provided in a way to be protruded from the extension part 32 of the hinge bracket 30 toward an upper portion to be inserted into a lower portion of the door 13.

The hinge shaft 50 may be integrally formed with the hinge bracket 30, or may be separately provided from the hinge bracket 30 to be fixedly coupled to the hinge bracket 30.

The worm wheel 80 may be screwed to the hinge shaft 50 so as to ascend/descend. For the above, at an outer circumferential surface of a lower portion of the hinge shaft 50, a male screw part 51 is provided, and at an inner circumferential surface of the worm wheel 80, a female screw part 82 may be provided.

The male screw part 51 of the hinge shaft 50 and the female screw part 82 of the worm wheel 80 may interoperate with each other, and according to the coupling degree of the male screw part 51 and the female screw part 82, the worm wheel 80 may be ascended with respect to the hinge shaft 50.

The worm 90 is provided to be engaged with the worm wheel 80 to rotate the worm wheel 80, and a worm shaft 91 is vertically provided with respect to a rotating axis of the worm wheel 80. A user, by rotating the worm 90, may be able to rotate the worm wheel 80 engaged with the worm 90.

A worm gear including the worm 90 and the worm wheel 80 is provided with a high deceleration ratio. Thus, when a user rotates the worm 90, the worm 90 may be easily rotated by use of small force, and the amount of the rotation of the worm wheel 80 may be delicately adjusted.

At this time, the worm 90 is provided at one end portion thereof with a worm operating part 92 to which a tool is coupled, to rotate the worm 90. The worm operating part 92 may be provided in a way that allows a screw driver, which is commonly available in a general household, to be coupled thereto.

The worm 90 as such may be rotatably supported by worm housings 95 and 96, and the worm housings 95 and 96 may be mounted at the extension part 31 of the hinge bracket 30.

The worm housings 95 and 96 may be formed as a upper worm housing 95 and a lower worm housing 96 are assembled together. At the lower worm housing 96, one or more coupling legs 98 and 99 may be formed, and the coupling legs 98 and 99 may be coupled to coupling holes 37 and 38 formed at the hinge bracket 30.

At this time, as illustrated on FIG. 3, at the hinge bracket 30, an extra coupling hole 39 may be additionally formed, and the hinge bracket 30 is being used for the lower hinge module 18 on the right, the lower worm housing 96 may be coupled to the coupling holes 38 and 39.

As illustrated on FIG. 3, at the lower worm housing 96, a supporting part 97 configured to rotatably support the worm 90 may be provided, and at the upper worm housing 95 as well, a supporting part (not shown) that corresponds to the supporting part 97 may be provided.

The worm 90 may be accommodated at an inside the worm housings 95 and 96, and the worm operating part 92 configured to rotate the worm 90 may be exposed to an outside the worm housings 95 and 96. The worm operating part 92 may be exposed to an outside a lateral side of the body 10.

The lower hinge module 17 may further include cam units 60 and 70 to open/close the door 13 semi-automatically. The cam units 60 and 70 may include a lower cam unit 60 fixed to the hinge bracket 3, and an upper cam 70 unit fixed to a lower portion of the door 13.

The lower cam unit 60 may be placed on a supporting surface 81 of the worm wheel 80. At the lower cam unit 60, a rotation preventing groove 62 is formed, and as a rotation preventing protrusion 36 formed at the hinge bracket 30 is inserted into the rotation preventing groove 62, the lower cam unit 60 may only be able to move vertically, while any movement in other directions may be limited.

Into an insertion hole 63 of the lower cam unit 60 as well as into an insertion hole 73 of the upper cam unit 70, the hinge shaft 50 may be inserted, and a cam surface 61 formed at an upper surface of the lower cam unit 60 and a cam surface 71 formed at a lower surface of the upper cam unit 70 may interoperate to open/close the door 13 semi-automatically.

Figure 5:
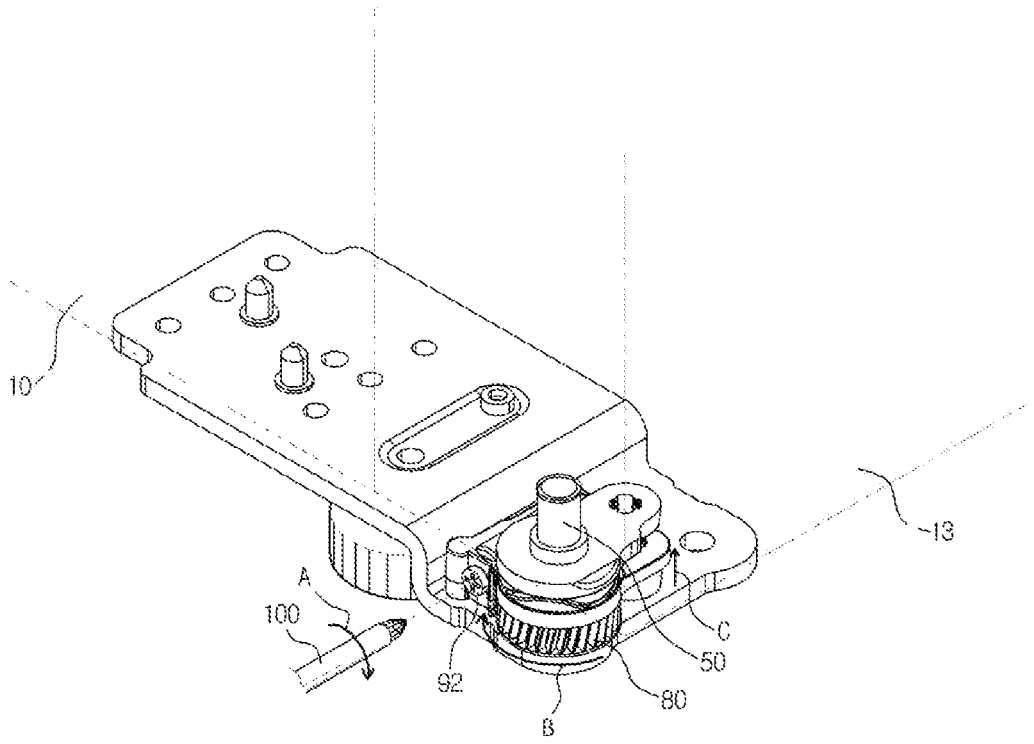
FIG. 5 is a drawing to describe an operation of adjusting the height of the refrigerator of FIG. 1

FIG. 5 is a drawing to describe an operation of adjusting the height of the refrigerator of FIG. 1.

Referring to FIG. 5, the operation of adjusting the height of the refrigerator in accordance with an embodiment of the present disclosure will be described.

As illustrated on FIG. 5, after a screw driver 100 is coupled to the worm operating part 92 provided at the worm, and then the screw driver 100 is rotated (A), the worm is rotated. As the worm is rotated, the worm wheel 80, which is engaged with the worm and screw-coupled to the hinge shaft 50, is rotated (B). At this time, since the deceleration ratio of the worm and the worm wheel 80 is large, a user may be able to rotate the worm wheel 80 by use of small force, and may also be able to delicately adjust the amount of the rotation of the worm wheel 80.

As the worm wheel 80 is rotated (B), the screw-coupling degree of the hinge shaft 50 to the worm wheel 80 is changed, and thus the worm wheel 80 is ascended or descended (C), and accordingly, the cam unit and the door 13 that are supported by the worm wheel 80 may ascend or descend.

In addition, as illustrated, the worm operating part 92 of the worm is exposed to a lateral side of the body 10, and thus a user may allow the screw driver 100 to easily approach the worm operating part 92.

As is apparent from the above description, in a refrigerator having a pair of doors rotatably coupled to a left side and a right side of a body of the refrigerator, respectively, the height difference of the pair of doors can be adjusted by adjusting the height of the doors.

A lower hinge module is provided with a worm gear having a large deceleration ratio, and thus, by use of small force, the height of the door may be delicately adjusted. In addition, a worm operating part to which a screw driver, a tool commonly used in a general household, may be coupled is provided at the worm, so that the height of the door may be easily adjusted in a general household.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator, comprising:

a body;

a storage compartment provided at an inside of the body;

a door rotatably provided at the body to open/close the storage compartment;

a hinge bracket having a fixation part being fixed to a lower surface of the body, and an extension part extended from the fixation part to be disposed below the door;

a hinge shaft protruded upward from the extension part to be inserted into a lower portion of the door, the hinge shaft provided at an outer circumferential surface thereof with a male screw part;

a worm wheel provided at an inner circumferential surface thereof with a female screw part corresponding to the male screw part of the hinge shaft to be screw-coupled to the hinge shaft so as to ascend/descend while supporting a weight of the door;

a worm engaged with the worm wheel to rotate the worm wheel, wherein the worm includes a worm shaft, a portion of the worm which is engaged with the worm wheel is provided at an outer circumferential part of the worm shaft, and one end of the worm shaft is externally exposed outside of the body and is configured to receive a tool outside of the body so that when the tool is received by the one end of the worm shaft and the tool is operated, the worm shaft is rotated;

a cam unit to allow the door to be semi-automatically opened/closed, the cam unit including a lower cam unit supported by the worm wheel, and an upper cam unit fixed to the door to interoperate with the lower cam unit, wherein the hinge shaft is inserted through an insertion hole provided in each of the lower cam unit and the upper cam unit; and a worm housing elongated in a longitudinal direction that is perpendicular to a front to rear direction of the body and configured to rotatably support the worm, wherein one longitudinal side of the worm housing faces the fixation part, and another longitudinal side of the worm housing faces away from the fixation part, and a side surface of the another longitudinal side of the worm housing includes an opening for the worm to be engaged with the worm wheel, the worm wheel being disposed outside of the worm housing and adjacent to the another longitudinal side of the worm housing.

2. The refrigerator of claim 1, wherein:

when the worm is rotated, the worm wheel engaged with the worm is rotated, when the worm wheel is rotated, a screw coupling degree of the worm wheel and the hinge shaft is changed, and thus the worm wheel is ascended or descended, and when the worm wheel is ascended or descended, the door being supported by the worm wheel is ascended or descended.

3. The refrigerator of claim 1, wherein:

a rotation preventing protrusion is provided at the hinge bracket, and the lower cam unit is provided with a rotation preventing groove into which the rotation preventing protrusion is inserted to prevent the lower cam unit from being rotated about the hinge shaft when the worm wheel ascends/descends.

4. The refrigerator of claim 1, wherein:

the worm housing comprises a lower worm housing fixed to the hinge bracket and an upper worm housing coupled to the lower worm housing.

5. The refrigerator of claim 1, wherein:

the hinge shaft is integrally formed with the hinge bracket, or is formed independently of the hinge bracket and fixedly coupled to the hinge bracket.

6. The refrigerator of claim 1, further comprising:

a supporting leg to support the weight of the body, wherein the hinge bracket is positioned between the lower surface of the body and the supporting leg.

7. The refrigerator of claim 1, wherein a rotating axis of the worm shaft is perpendicular to a rotating axis of the worm wheel, and the one end of the worm shaft is configured to receive the tool and the tool is a screwdriver.

8. The refrigerator of claim 1, wherein the worm housing includes a lower worm housing fixed to the extension part via at least one coupling hole provided in the extension part, and an upper worm housing coupled to the lower worm housing.

9. The refrigerator of claim 8, wherein a supporting part is provided at an interior side of the worm housing and between opposite ends of the worm housing, to rotatably support the worm.

10. The refrigerator of claim 1, wherein the lower cam unit is disposed on a supporting surface of the worm wheel, and the upper cam unit is disposed above the lower cam unit and fixed to the door to interoperate with the lower cam unit, and a bottom surface of an end portion of the lower cam unit has a circular shape and a circumference which is substantially the same as a circumference of the worm wheel.

11. The refrigerator of claim 10, further comprising a rotation preventing protrusion provided at the hinge bracket, and the lower cam unit is provided at another end portion thereof with a rotation preventing groove into which the rotation preventing protrusion is inserted to prevent the lower cam unit from being rotated about the hinge shaft when the worm wheel ascends/descends.

12. The refrigerator of claim 1, wherein at least a portion of the another longitudinal side of the worm housing in which the opening is disposed has a concave shape.

13. A refrigerator, comprising:

a body;

a plurality of storage compartments provided at an inside of the body;

a plurality of doors rotatably provided at the body to open/close the plurality of storage compartments; and a plurality of lower hinge modules configured to respectively support the plurality of doors, and respectively adjust heights of the plurality of doors, wherein at least one of the lower hinge modules comprises:

a hinge bracket connecting the body to the door;

a hinge shaft inserted into a lower portion of the door;

a worm wheel screwed to the hinge shaft so as to ascend/descend while supporting a weight of the door;

a worm engaged with the worm wheel to rotate the worm wheel, wherein the worm includes a worm shaft, a portion of the worm which is engaged with the worm wheel is provided at an outer circumferential part of the worm shaft, and one end of the worm shaft is externally exposed outside of the body and is configured to receive a tool outside of the body so that when the tool is received by the one end of the worm shaft and the tool is operated, the worm shaft is rotated; and a cam unit to allow the door to be semi-automatically opened/closed, the cam unit including a lower cam unit supported by the worm wheel, and an upper cam unit fixed to the door to interoperate with the lower cam unit, wherein the hinge shaft is inserted through an insertion hole provided in each of the lower cam unit and the upper cam unit; and a worm housing elongated in a longitudinal direction that is perpendicular to a front to rear direction of the body and configured to rotatably support the worm, wherein one longitudinal side of the worm housing faces toward the rear of the body, and another longitudinal side of the worm housing faces toward the front of the body, and a side surface of the another longitudinal side of the worm housing includes an opening for the worm to be engaged with the worm wheel, the worm wheel being disposed outside of the worm housing and adjacent to the another longitudinal side of the worm housing.

14. The refrigerator of claim 13, wherein a rotating axis of the worm shaft is perpendicular to a rotating axis of the worm wheel.

15. A lower hinge module configured to support a door of a refrigerator, the lower hinge module comprising:

a hinge bracket having a fixation part configured to be fixed to a lower surface of a body of the refrigerator, and an extension part extended from the fixation part and configured to be disposed below the door;

a hinge shaft protruded upward from the extension part and configured to be inserted into a lower portion of the door;

a worm wheel screw-coupled to the hinge shaft and configured to ascend/descend while supporting a weight of the door;

a worm engaged with the worm wheel to rotate the worm wheel, wherein the worm includes a worm shaft, a portion of the worm which is engaged with the worm wheel is provided at an outer circumferential part of the worm shaft, and one end of the worm shaft is externally exposed outside of the body and is configured to receive a tool outside of the body so that when the tool is received by the one end of the worm shaft and the tool is operated, the worm shaft is rotated; and a cam unit to allow the door to be semi-automatically opened/closed, the cam unit including a lower cam unit supported by the worm wheel, and an upper cam unit to be fixed to the door to interoperate with the lower cam unit, wherein the hinge shaft is inserted through an insertion hole provided in each of the lower cam unit and the upper cam unit; and a worm housing elongated in a longitudinal direction that is perpendicular to a front to rear direction of the body and configured to rotatably support the worm, wherein one longitudinal side of the worm housing faces the fixation part, and another longitudinal side of the worm housing faces away from the fixation part, and a side surface of the another longitudinal side of the worm housing includes an opening for the worm to be engaged with the worm wheel, the worm wheel being disposed outside of the worm housing and adjacent to the another longitudinal side of the worm housing.

16. The lower hinge module of claim 15, wherein:

a male screw part is formed at an outer circumferential surface of the hinge shaft, and a female screw part corresponding to the male screw part is formed at an inner circumferential surface of the worm wheel.

17. The lower hinge module of claim 15, wherein:

the hinge shaft is integrally formed with the hinge bracket, or is independently formed of the hinge bracket and is fixedly coupled to the hinge bracket.

18. The lower hinge module of claim 15, wherein a rotating axis of the worm shaft is perpendicular to a rotating axis of the worm wheel.

19. The lower hinge module of claim 18, wherein the one end of the worm shaft is configured to receive the tool and the tool is a screwdriver.

* * * * *